United States Patent [19]

Kelley

[11] Patent Number: 4,635,940

[45] Date of Patent: Jan. 13, 1987

[54] DART BOARD ASSEMBLY FOR AN ELECTRONIC DART GAME

[75] Inventor: Frederick T. Kelley, Cary, Ill.

[73] Assignee: William E. McClure, Hoffman Estates, Ill. ; a part interest

[21] Appl. No.: 749,584

[22] Filed: Jun. 26, 1985

[51] Int. Cl.[4] ..... F41J 3/00; F41J 5/04

[52] U.S. Cl. ..... 273/347; 273/376

[58] Field of Search ..... 273/347, 374, 375, 376

[56] References Cited

U.S. PATENT DOCUMENTS

| | | | |
|---|---|---|---|
| 2,523,773 | 9/1950 | Metzger | 273/375 |
| 3,454,276 | 7/1969 | Brenkert et al. | 273/376 |
| 3,972,531 | 8/1976 | Knapp | 273/376 |
| 4,057,251 | 11/1977 | Jones et al. | 273/376 |
| 4,516,781 | 5/1985 | DeVale et al. | 273/373 |

FOREIGN PATENT DOCUMENTS

| | | | |
|---|---|---|---|
| 1334767 | 7/1963 | France | 273/347 |

*Primary Examiner*—Anton O. Oechsle

*Attorney, Agent, or Firm*—Fitch, Even, Tabin & Flannery

[57] ABSTRACT

A dart board assembly for use in an electronic dart game. The assembly includes a frame having an inner end, an outer end, and an axis and including a generally annular central wall defining a bull's-eye. The frame includes a number of radial walls extending away from the central wall and a circular wall, concentric with the central wall, with each of the walls extending between the frame ends and the walls defining the plurality of spaces. A target segment is disposed in each of the spaces and includes a target plate having a great plurality of closely spaced apertures for receiving the pointed shaft of a dart. The plate is shaped to engage an enlarged rib forming a constricted throat of its space to prevent movement of the target out through the outer end of the frame. Each target segment includes at least a pair of space legs extending from the target plate toward the inner end of the frame with each leg being engageable with a pair of the walls forming the frame. The target segment is open between the legs, with each leg terminating in a small protuberance. The assembly also includes a switching matrix having contact means associated with each of the legs and aligned with the protuberance carried by the corresponding leg.

14 Claims, 16 Drawing Figures

FIG.9
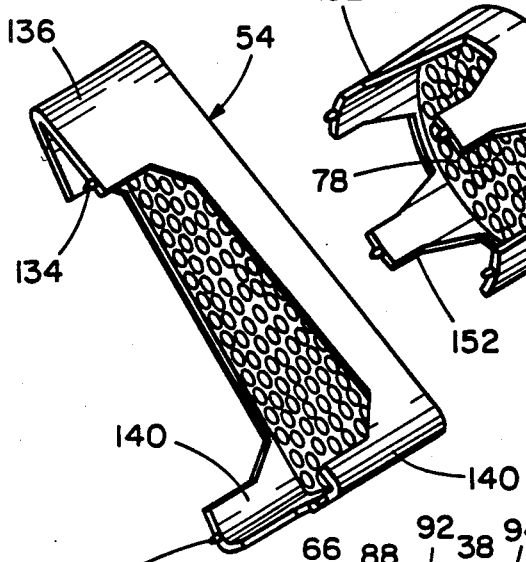
FIG.8
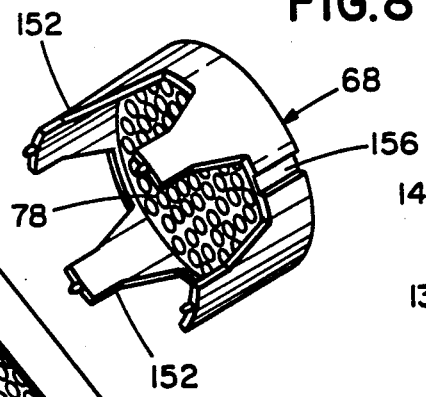
FIG.10
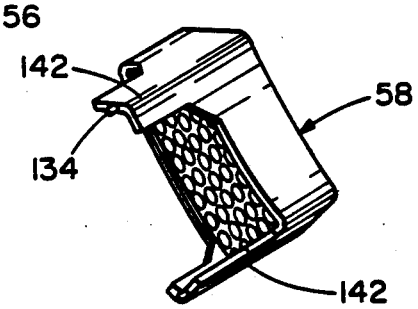
FIG.14
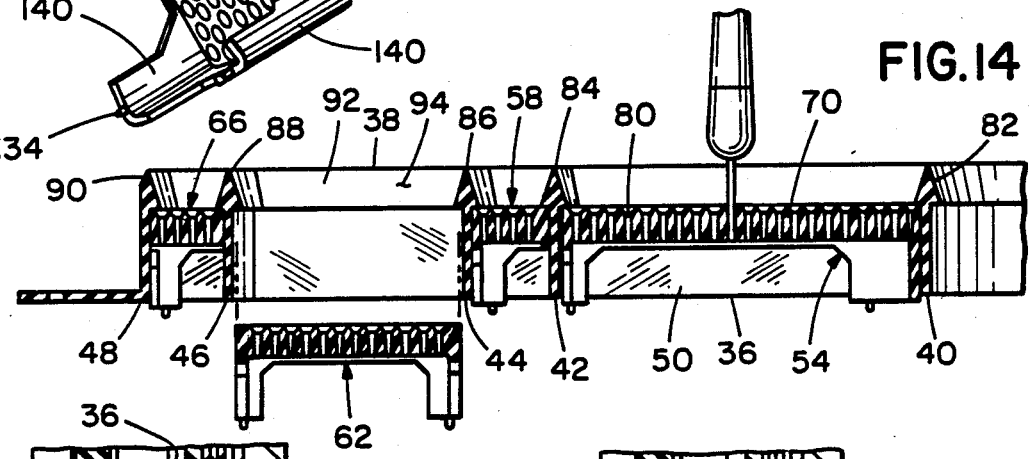
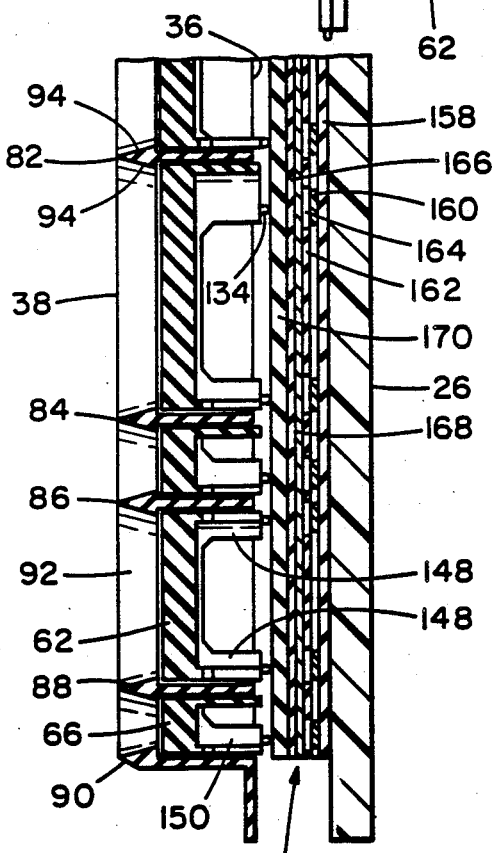
FIG.15
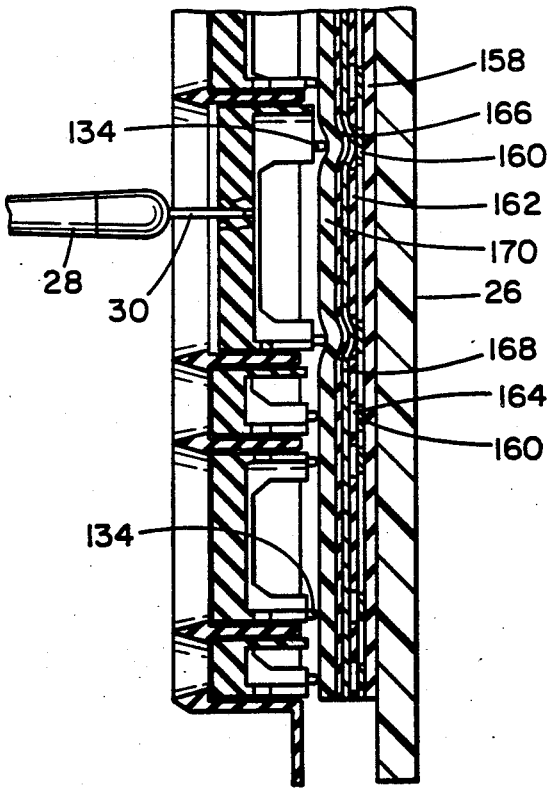
FIG.16

DART BOARD ASSEMBLY FOR AN ELECTRONIC DART GAME

The present invention relates to amusement equipment and, more particularly, to an improved dart board assembly for an electronic dart game.

BACKGROUND OF THE INVENTION

Electronic dart games have become increasingly popular for commercial amusement purposes. Such games include dart board assemblies having a number of slidable apertured target segments held in a frame for striking a switch array in response to being hit by a blunt nosed dart. The various switches are interconnected with electronic scoring and readout circuitry. These games are often subjected to frequent and severe use. Improvements in ruggedness and reliability are always desirable for such applications.

In one prior art electronic dart game, the target segments were in the form of cups having a closed end wall and the apertured target plate was cemented in, and spaced from the open end of the cup. Such target segments, while performing generally satisfactorily, retained broken dart tips, were susceptible to becoming jammed in the frame upon being struck near the perimeter of the target plate and were relatively expensive to manufacture. For further information regarding the operation and structure of such a dart game, reference may be made to U.S. Pat. No. 4,057,251.

In another electronic dart game, the target segments each had closed side walls extending rearwardly from the target plate to form an enclosed space behind the target plate. A number of rectangular protuberances were disposed on the rear surface of the side walls. The frame for the segments had walls defining target segment spaces, with the walls having guide ribs for engaging the side wall of the segment intermediate the peripheral corners of the target plate. This portion of the side wall was very flexible and a dart striking near the periphery of the plate could cause the segment to become jammed in the frame. For further information regarding the operation and structure of this dart game, reference may be made to U.S. Pat. No. 4,516,781.

SUMMARY OF THE INVENTION

Among the several aspects and features of the present invention may be noted the provision of an improved dart board assembly for an electronic dart game. The target segments are much less likely to become wedged in a jam condition in the frame so that they cannot slide with respect to the frame, because areas of contact between the target segments and surrounding portions of the frame have been greatly reduced. The target segments are of open, molded plastic construction so that broken dart tips cannot collect as occurs with closed target segments. The target segments are also of reduced weight. The segments have legs terminating in small protuberances extending beyond the frame for transmitting force to a switching matrix, the operation of which supplies inputs to electronic scoring circuitry. The dart board assembly of the present invention is rugged and reliable in use, has long service life, and is easy and economical to manufacture.

Briefly, the dart board assembly includes a frame of integral plastic construction having an inner end, an outer end, and an axis. The frame includes a central wall defining a bull's-eye, a number of radial walls extending away from the central wall and a circular wall. Each of the walls extend between the frame ends and the walls define a plurality of spaces. At least certain of the walls have an enlarged rib at the outer end of the frame forming a constricted throat for each of the spaces. A target segment of integral plastic construction is positioned in each space and includes a target plate having a plurality of closely spaced apertures for receiving the blunt nosed shaft of a dart. The plate is shaped to engage the enlarged rib forming the throat of its space to prevent movement of the target segment through the throat. Each target segment further includes at least a pair of spaced legs extending from the target plate toward the inner end of the frame with each of the legs being engageable with at least two of the walls forming the frame. The target segment is open between the legs with each leg terminating in a small protuberance. The dart board assembly further includes a switching matrix disposed adjacent the inner end of the frame and having a pair of contacts associated with each of the legs and aligned with the protuberance carried by the leg. The pair of contacts is biased to an open circuit condition and adapted for movement to a closed circuit condition due to force applied by the corresponding protuberance upon a dart striking the associated target segment.

BRIEF DESCRIPTION OF THE DRAWINGS

FIGS. 8–10 are perspective views of the bull's-eye target segment and pie-shaped and triple target segments, respectively;

FIG. 14 is a sectional view of the frame illustrating target segments being inserted;

FIG. 15 is a sectional view showing the frame and switching matrix mounted on a support board with a resilient sheet disposed between the target segments and matrix for biasing the segments away from the matrix; and FIG. 16, similar to FIG. 15, illustrates a dart striking a target segment resulting in the closing of a pair of contacts.

Corresponding reference characters indicate corresponding components throughout the several views of the drawings.

DESCRIPTION OF THE PREFERRED EMBODIMENT

Figure 1:
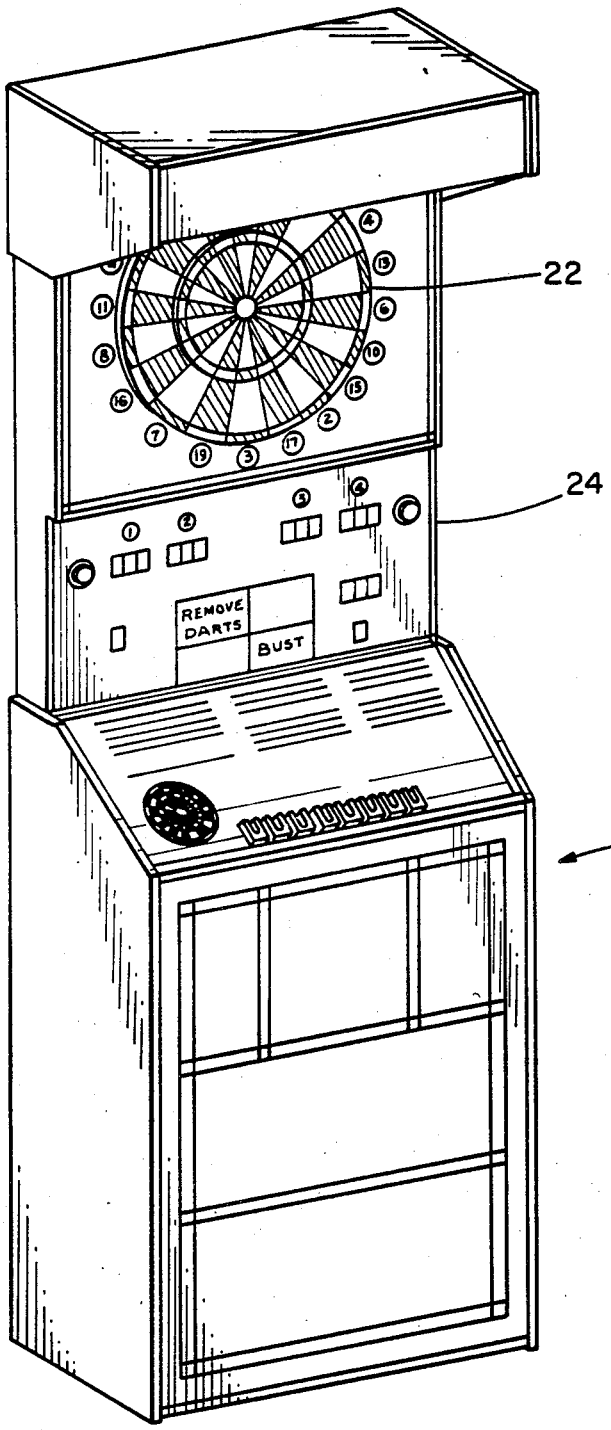
FIG. 1 is a perspective view of an electronic dart game including a dart board assembly embodying various features of the present invention.

Referring now to the drawings, a dart board assembly embodying various features of the present invention for use in an electronic dart game 20, is generally indicated by reference numeral 22 in FIG. 1. The dart game 20 includes a housing 24 enclosing electronic circuitry for automatic scoring and providing readouts, as well as providing other functions. The housing has various controls and selectors for use by the players. Additionally, the dart game has a frame holding a support 26, which might take the form of a board best shown in FIGS. 15 and 16, for attachment of the board assembly 22. Such automatic scoring and readout circuitry and controls are well known to those of skill in the art and do not form a part of the present invention. As will appear more fully hereinafter, the dart board assembly 22 provides electrical switching for use in supplying input signals to the circuitry. The assembly is for use with darts 28 having shafts 30 made of relatively soft material with blunt ends to greatly lessen any chance of injury to a person or object struck by a dart.

Figure 2:
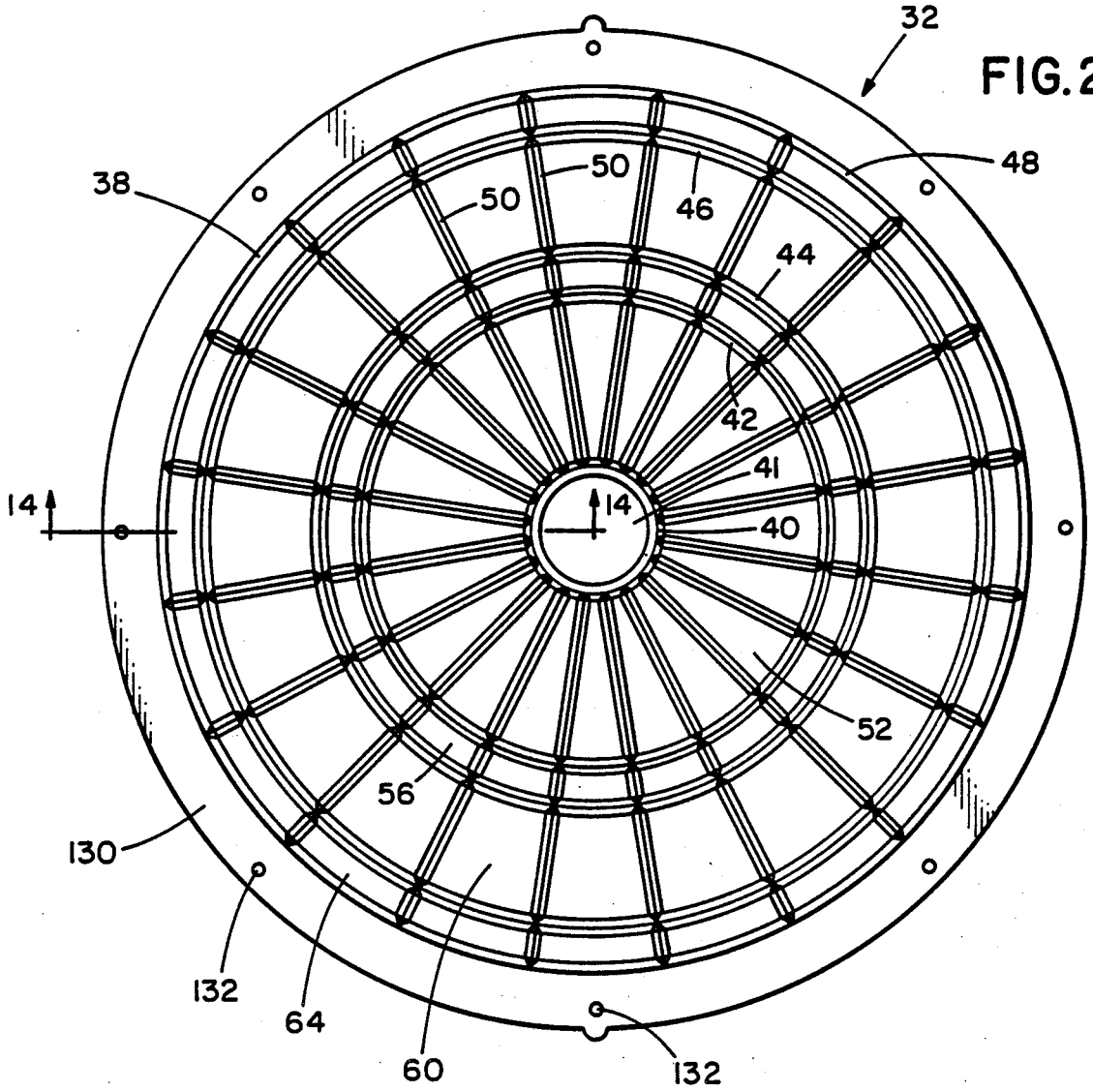
FIG. 2 is a front elevational view showing the outer end of a frame of the board assembly of FIG. 1 including various circular and radial walls defining spaces for receiving a bull's-eye target segment and surrounding arrays of pie-shaped, triple, single and double target segments.
Figure 11:
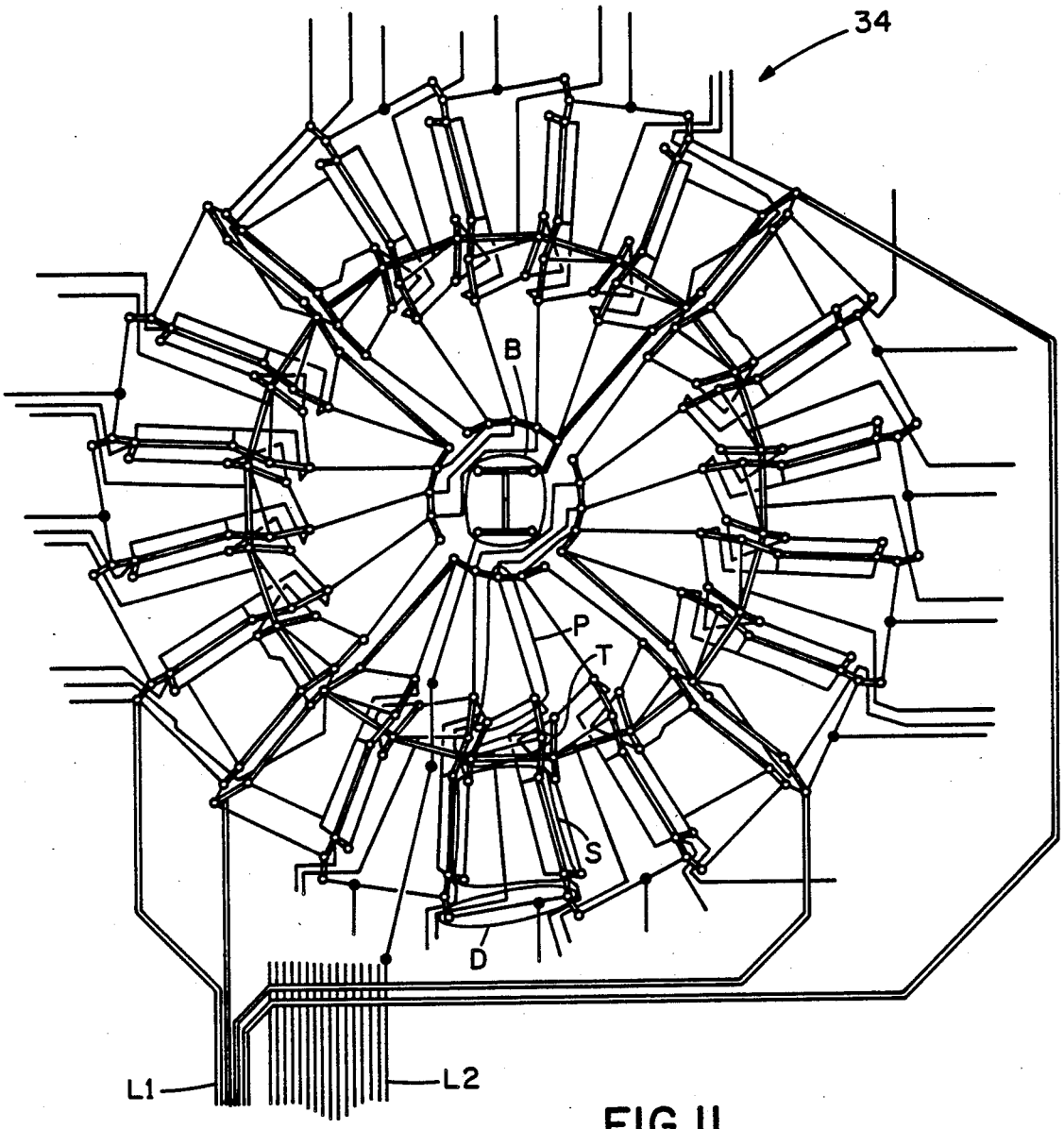
FIG. 11 is a front elevational view of various components of a switching matrix including a number of sets of contacts the closing of which is effected by movement of corresponding target segments.
Figure 12:
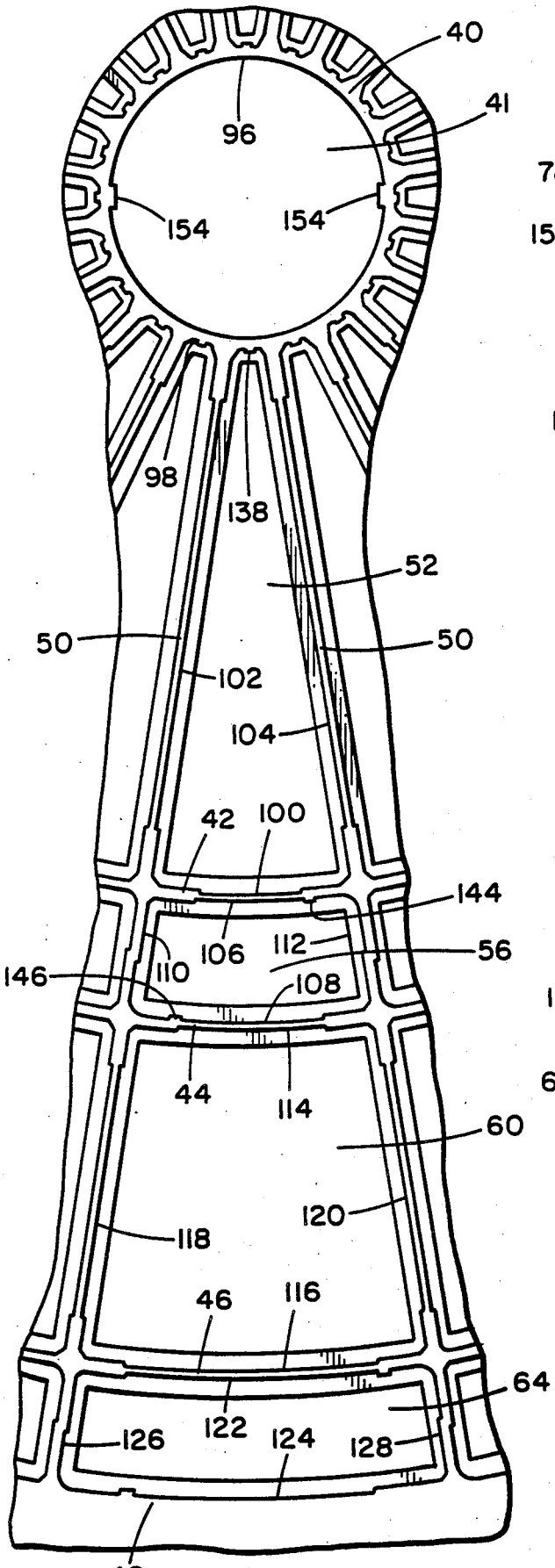
FIG. 12 is a rear elevational view of a portion of the inner end of the frame illustrating spaces for receiving the bull's-eye and pie-shaped, triple, single and double target segments.
Figure 13:
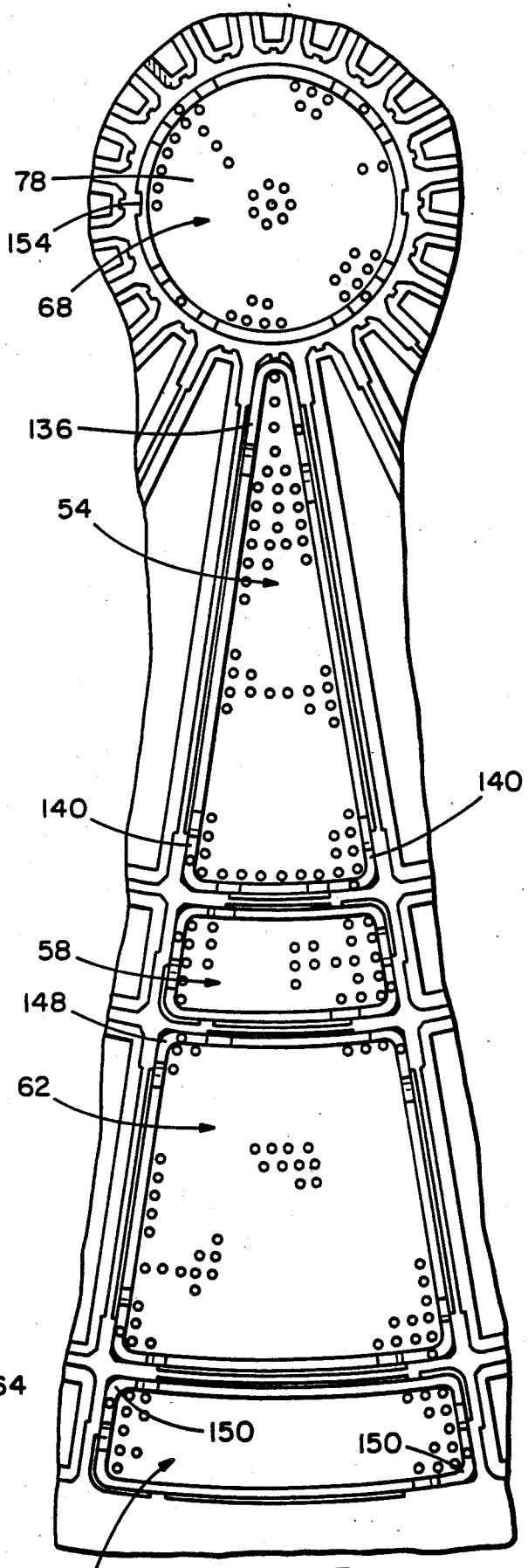
FIG. 13, similar to FIG. 12 shows target segments disposed in the spaces defined by the frame.

The dart board assembly 22 includes a frame 32, best shown in FIGS. 2 and 12, a plurality of target segments for receiving the darts, and a switching matrix 34 (best shown in FIGS. 11, 15 and 16) which is responsive to a dart impacting a target segment to switch an input to the electronic circuitry. The frame is of integral molded plastic construction with styrene being a preferred material. The frame 32 which is symmetrical about a central axis, includes an inner end 36 facing the switching matrix and an outer end 38 facing the player(s). A generally annular central wall 40 defines a bull's-eye space 41 and the frame further includes first, second and third intermediate circular walls, 42, 44 and 46, respectively, and a peripheral wall 48 all of which are concentric with central wall 40. Twenty regularly spaced radial walls 50 interconnect the central wall 40 and the peripheral wall 48 and these walls, along with the intermediate walls 42–46, define four concentric annular arrays of twenty spaces each for target segments.

Figure 3:
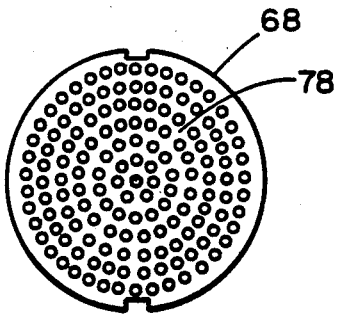
FIGS. 3–7 are front elevational views of a bull's-eye target segment and pie-shaped, triple, single and double target segments, respectively.
Figure 4:
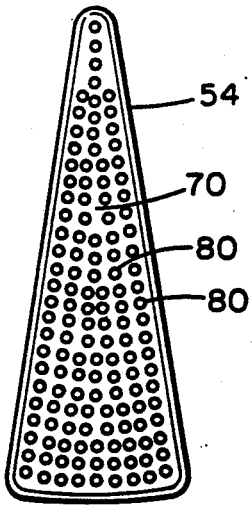
Figure 6:
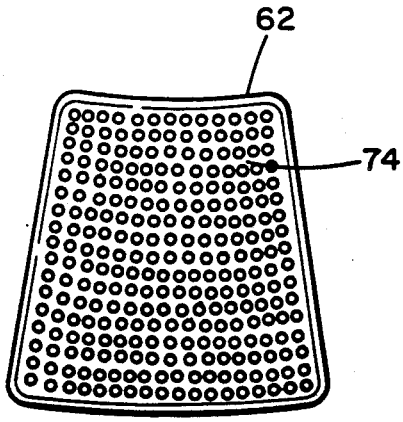
Figure 5:
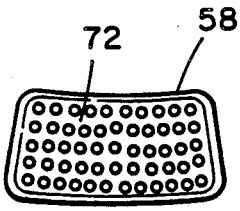
Figure 7:
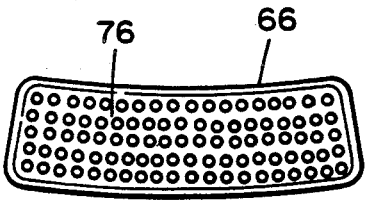

More specifically, an inner array of spaces 52, generally triangular in section, slidably receive pie-shaped target segments 54 best shown in FIGS. 4 and 9. Surrounding the inner spaces 52 are triple spaces 56, each slidably receiving a triple target segment 58 best shown in FIGS. 5 and 10. Next radially outwardly are the single spaces 60 in each of which is disposed a single target segment 62 best shown in FIG. 6. The outermost array is composed of the double spaces 64 in which are disposed double target segments 66 shown in FIG. 7. An aligned one of each of the four arrays of spaces forms a scoring radial to which is conventionally assigned a point value with the particular space in the radial determining a multiplier for that particular point value. Slidably positioned in the bull's-eye space 41 is a generally round bull's-eye target segment 68 shown in FIG. 3.

Each target segment 54, 58, 62, 66 and 68, shaped similarly to its respective space, is preferably of integral molded plastic construction (a preferred material being nylon) and includes a target plate 70, 72, 74, 76 and 78, respectively, having a great plurality of closely spaced apertures 80 for receiving the dart shafts. As best shown in FIG. 14, the apertures converge in the direction of the frame inner end 36 and are proportioned to receive and wedge the bluntly pointed shaft 30 of a dart 28 but to prevent a broken shaft from passing through the target plate. By way of example, each aperture could converge from a diameter of 0.075" adjacent the outer end 38 of the frame 32, to a diameter of about 0.060". This feature has the advantage that, while broken shafts cannot pass through the target plate, upon periodic disassembly of the board assembly 22, any broken shafts can be dislodged from a target segment by using a tool with a small diameter shaft to push such shafts back through the entry side of the target plate. Each of the apertures has a chamfered or guide entry surface with entry surfaces of adjacent apertures merging so that a dart striking the apertured field of the target plate is highly likely to have its shaft guided into and retained by one of the apertures 80 due to wedging.

The frame walls 40, 42, 44, 46, 48 and radial walls 50 each are provided with enlarged ribs 82, 84, 86, 88, 90 and 92, respectively, at the outer end 38 of the frame 32 partially overlying respective spaces formed by the various walls and forming constricted throats for the spaces for engaging corresponding target plates so that the various target segments cannot be withdrawn through the outer end of the frame. Each of the ribs is generally triangular in section, having inclined sides 94 coming to an apex at the outer end of the frame so that a dart striking a rib is deflected by an inclined side 94 into the apertured field of one of the target segments.

Referring to FIG. 12, the central wall 40 has a side surface 96 facing the axis of the frame which defines the bull's-eye space 41. As each of the twenty scoring radials is identical, only one need be described in detail. The central wall has an outside surface 98 and the first circular wall 42 has a facing inner surface 100. These surfaces, along with facing surfaces 102 and 104 of a pair of radial walls 50, define the triangular space 52 for reception of the pie-shaped target segment 54. The triple space 56 is defined by first circular wall 42 outside surface 106, the second circular wall 44 inside surface 108, and facing surfaces 110 and 112 of the pair of radial walls 50. Similarly, the single space 60 is defined by the outside surface 114 of second circular wall 44, the inside surface 116 of the third circular wall 46, and surfaces 118 and 120 of radial walls 50; while the double space 64 is defined by the outside surface 122 of the third circular wall 46, the inside surface 124 of the peripheral wall 48 and surfaces 126 and 128 of the pair of radial walls 50. The peripheral wall 48 also has a peripheral mounting skirt 130 (best shown in FIG. 2) at the inner end 36 of the frame having openings 132 for receiving fasteners for attaching the frame to the support board 26.

Each of the target segments 54, 58, 62 and 66 includes at least a pair of spaced legs extending from the target plate toward the inner end 36 of the frame 32 with each leg being engageable with at least two of the walls defining the space for that target segment. Each leg terminates in a small protuberance 134 extending beyond the inner end 36 of the frame in all positions of the target segment. As will appear more fully hereinafter, these protuberances function to apply force to the switching matrix 34 to close a set of contacts in response to a dart striking a target segment. More specifically, each pie-shaped target segment 54 includes a proximal leg 136 engageable with the pair of radial walls 50 and a guide rib 138 extending from the central wall outside surface 98. This leg 136 is generally V-shaped and the protuberance 134 carried by it is positioned remote from the central wall 40 to lessen congestion of contacts on the switching matrix 34 in the area of the central wall 40.

The pie-shaped target segment 54 also includes a pair of L-shaped distal legs 140 with one leg 140 engageable with first wall inner surface 100 and radial wall surface 102 and the other leg 140 engageable with surface 100 and the other radial wall surface 104 defining space 52. Thus, the target segment 54 has a leg at each corner thereof and the target segment 54 is open between adjacent legs. The central portions of radial wall surfaces 102, 104 and of first wall inner surface 100 which are not aligned for engagement with the three legs of segment 54 are depressed, preferably about 0.015". The provision of openings between the adjacent legs and the depression of the central portions of the surface defining the space 52 cooperate to greatly lessen the possibility that the segment 54 could become jammed (i.e., frictionally held against sliding so that switching contacts remained closed or could not be moved to close) because the areas of engagement between the target segment and surrounding surfaces of walls of the frame have been greatly reduced. Not only do target segments of the dart board assembly 22 exhibit reduced friction, they also have substantially less weight than prior art target segments.

The generally rectangular, but arched triple target segment 58, shown in FIG. 10, includes a pair of generally diametrically opposed L-shaped legs 142. One of the legs 142 can contact first wall outside surface 106 and radial wall surface 110, while the other leg 142 is able to engage second wall inside surface 108 and radial wall surface 112. Again the portions of surfaces 106, 108, 110 and 112 not aligned with the legs 142 are depressed preferably about 0.015" except that first wall surface 106 has an axial guide rib 144 adjacent radial wall surface 112 for abutting the triple target plate 72. Similarly, second wall surface 108 has an axial guide rib 146 adjacent radial wall surface 110. The guide ribs 144 and 146 limit rotational movement of the triple target segment 58 in the space 56, but permit substantially unimpeded translational movement of the target segment in the axial direction of the frame 32.

The single target segment 62 and the wall surfaces defining the single space 60 have constructions similar to that previously described with respect to the pie-shaped segment 54 and space 52 therefor, except the single target segment 62 has four legs 148, one at each corner thereof. The double target segment 66, having opposed legs 150, and its space 64 are, in essence, elongated versions of the above-described triple segment 58 and space 56 therefor.

The bull's-eye target segment 68 has four arcuate legs 152 engageable with the central wall inside surface 96. In order to maintain alignment of legs 152 and the corresponding contacts of the switching matrix 34, the segment 68 and surface 96 are provided with anti-rotation means. More specifically, surface 96 has a pair of diametrically opposed axial guide tongues 154 for reception in opposed grooves 156 in the periphery of the bull's-eye target plate 78. It will be appreciated that each of the target segments has dimensions slightly less the corresponding dimensions defining the space for receiving that particular target segment. Thus, each of the target segments is slidable in its space. That is, translational movement of the target segment between the ends of the frame is substantially unimpeded by the walls of the frame.

Referring to FIGS. 11, 15 and 16, an example of one possible construction of the switching matrix 34 is shown. The matrix is of laminated construction including an insulative inner contact sheet 158 in full surface engagement with the support board 26. Printed on the inner sheet are a plurality of contacts 160 with one contact in alignment with a protuberance of each leg of each target segment. These contacts are connected by conductive stripes to sixteen output leads L2 (connected to the electronic circuitry) in such a manner that energization of a particular inner contact will provide energization to one or more of the leads L2 which is unique to a particular target segment. Overlying the inner contact sheet 158 is an insulative spacer sheet 162 having apertures 164 with each contact 160 disposed in a corresponding aperture. Overlying the spacer sheet is a resilient outer contact sheet 166 on which is printed an outer contact 168 in alignment between each leg protuberance 134 and each inner contact 160. The outer contacts 160 may be connected by conductive stripes to one of four leads L1 which, according to one possible architecture, may be energized. It will be appreciated that the relative spacing between aligned pairs of contacts is exaggerated for ease of illustration.

Each aligned pair of contacts are closely spaced so that very little movement of the outer contact is required for a closed circuit condition to be achieved. Disposed between the switching matrix and the target segments is a resilient sheet 170, which may have a thickness of 0.055 of 0.060", which functions to bias the various target segments outwardly against the enlarged ribs of the walls forming constricted throats for the various spaces at the outer end 38 of the frame 32. Preferably the protuberances, in all positions of the target segments, are in contact with the resilient sheet 170. This reduces lost motion in the movement of the target segments and makes the dart board assembly 22 of the present invention extremely sensitive to impact of a dart 28 resulting in a signal unique to a particular target segment being provided to the electronic circuitry of the dart game 20. Referring to FIG. 11, the contacts 160 enclosed by circle B are associated with the bull's-eye target segment 68. For one scoring radial, the contacts enclosed by circle P are for the pie-shaped segment 54; those encompassed by loop T are for the triple segment 58; those closed by circle S are related to the single segment 62; and those enclosed by loop D are for the double segment 66.

This is only one possible construction of the switching matrix 34. For example, the spacer sheet 162 could be replaced with a plurality of adhesive patches, in a dot matrix form, deposited on the outer contact sheet 166 to hold the sheets together in aligned, slightly spaced relationship. An insulative coating could also be deposited on the stripes and on the various contacts with the coating removed in the central portion of the contacts.

The operation of the dart board assembly 22 of the present invention is as follows: Referring to FIGS. 15 and 16, the various target segments are initially biased against the enlarged ribs at the outer end 38 of the frame 32 due to the resilient sheet 170 bearing against the various leg protuberances 134, as well as due to the resiliency of the outer contact sheet 166. Upon a dart striking a target segment, one or more of the protuberances carried by the legs of that target segment move inwardly toward their aligned outer contacts 168 carried on the outer contact sheet 166 thereby causing these contacts to engage the aligned inner contacts 160 carried by the inner contact sheet 158. This establishes a continuous electrical path between one of the input leads L1 and the one or more output leads L2 associated with that particular target segment, thereby providing a signal to the electronic componentry as to which of the target segments has been impacted by the dart. It will be appreciated that if a dart strikes a target segment adjacent to the periphery of the target segment, the target segment may undergo both limited rotational movement as well as translational movement. In this case, it is possible that only one leg will cause closing of the contacts 160 and 168 aligned with that leg. However, only one contact closing is needed to effect indication of the impacted target segment. It will be appreciated that the protuberances 134 are relatively small compared to the legs which carry them. This has the advantage that the rounded protuberance can provide a highly localized stress concentration causing inward deflection of a small portion of the resilient sheet 170 and the outer contact 168 aligned therewith to cause that contact to engage its corresponding outer contact 160. After the contact closing, due to the action of resilient sheet 170 and resilient outer contact sheet 166, the target segment is immediately returned to its starting position adjacent to the outer end of the frame. It will be appreciated that due to the limited frictional contact between the target segments and the associated wall segments defining the space for that target segment, it is relatively unlikely that a particular target segment would become jammed even if struck forcefully adjacent its periphery.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A dart board assembly for use in an electronic dart game, said assembly comprising:

a frame of integral plastic construction having an inner end, an outer end and an axis comprising a generally annular central wall defining a bull's-eye, a plurality of radial walls extending away from said central wall, and a circular wall, concentric with said central wall and spaced therefrom, each of said walls extending intermediate said ends and said circular wall and said radial walls defining, at least in part, a plurality of spaces;

said central wall and said circular wall having side surfaces disposed toward said axis, and said radial walls each having a pair of side surfaces with a side surface of each radial wall facing a side surface of an adjacent radial wall, at least certain of said walls having an enlarged rib at said outer end forming a constricted outer throat for each of said spaces;

a target segment of integral plastic construction disposed in each of said spaces including a target plate having a great plurality of closely spaced apertures for receiving the shaft of a dart, each said plate being shaped so that it engages the enlarged rib forming the throat of its space to prevent movement of said target segment through the throat, each of said target segments further comprising at least a pair of spaced legs extending from said target plate toward said inner end of said frame with each of said legs being engageable with at least two of the aforementioned walls, said target segments being open between said legs with each leg terminating in a small protuberance; and a switching matrix disposed adjacent said inner end of said frame and having contact means associated with each of said legs and aligned with the protuberance carried by the corresponding leg, each contact means comprising a pair of contacts biased to one of an open circuit condition and a closed circuit condition and adapted for movement to the other circuit condition due to force applied by the corresponding protuberance upon a dart striking the corresponding target segment.

2. A dart board assembly as set forth in claim 1 wherein the side surfaces of radial walls defining each space are depressed between areas of contact by the legs of the target segment disposed in that space whereby frictional contact between the target segment and said radial walls is reduced.

3. A dart board assembly as set forth in claim 1 wherein a resilient sheet is disposed between said inner end of said frame and said switching matrix for biasing said target segments toward the outside end of said frame.

4. A dart board assembly as set forth in claim 1 wherein said circular wall is a first circular wall and said target segments are first pie-shaped target segments and said spaces are first spaces, each of said first segments including a proximal leg engageable with said central wall and both radial walls defining the space in which the segment is disposed, each first segment also including a pair of distal legs each of which is engageable with a radial wall and said first circular wall.

5. A dart board assembly as set forth in claim 4 wherein the protuberance carried by said proximal leg is positioned remote from said central wall.

6. A dart board assembly as set forth in claim 4 wherein said frame further includes a second circular wall generally concentric with and outwardly spaced from said first circular wall, said first and second circular walls and said radial walls defining a plurality of second spaces, said assembly further including a second target segment slidably disposed in each second space.

7. A dart board assembly as set forth in claim 6 wherein each second target segment includes an apertured target plate and a pair of generally diametrically opposed legs extending from said target plate toward said frame inside end with each terminating in a small protruberance, one of said pair of legs engaging a first radial wall and said first circular wall and the other of said pair of legs engaging a second radial wall and said second circular wall.

8. A dart board assembly as set forth in claim 7 wherein said first circular wall has a rib adjacent said second radial wall for engaging said apertured target plate, and said second circular wall has a rib adjacent said first radial wall for engaging said apertured target plate.

9. A dart board assembly as set forth in claim 1 further comprising a peripheral circular wall which is generally concentric with said circular wall and from which extends a peripheral mounting skirt.

10. A dart board assembly as set forth in claim 1 wherein said side surface of said central wall defines a bull's-eye opening in which is received a bull's-eye target segment including a substantially round apertured target plate, the last-mentioned target segment including a plurality of regularly spaced legs engageable with said surface of said central wall and extending toward said frame inner end with each terminating in a small protuberance.

11. A dart board assembly as set forth in claim 10 wherein said central wall and said bull's-eye target assembly include means for holding said bull's-eye target assembly from rotation.

12. A dart board assembly as set forth in claim 1 wherein in all positions of said target segments said protuberances extend beyond said inside end.

13. A dart board assembly as set forth in claim 1 wherein the apertures in each target plate converge in the direction of said frame inner end and are proportioned to receive and wedge the shaft of a dart but to prevent a broken shaft from passing through the target plate.

14. A dart board assembly including a plurality of target segments and other components, said plurality of target segments being slidably retained by said other components of said assembly, each target segment being of integral plastic construction and comprising:

a target plate having a great plurality of closely spaced apertures for receiving the shaft of a dart, said target plate having a dart entry side and an inner side spaced from entry side with said apertures extending between said sides; and at least a pair of spaced legs disposed at the periphery of said plate and extending away from said entry side, each leg terminating in a small protuberance at the free end thereof, with the target segment being open between said legs, said target plate having peripheral corners, each leg being positioned at one of said corners, said segment being pie-shaped, having a proximal peripheral corner and two distal peripheral corners, said segment having a proximal leg and two distal legs, said proximal leg being V-shaped with the protuberance on said proximal leg being disposed remote from the apex of the V.

* * * * *